US011998832B2

(12) United States Patent
Eckart et al.

(10) Patent No.: US 11,998,832 B2
(45) Date of Patent: Jun. 4, 2024

(54) BRAKE ARRANGEMENT FOR A TOURING BINDING

(71) Applicant: Salewa Sport AG, Denges (CH)

(72) Inventors: Uwe Eckart, Munich (DE); Matthias Duve, Munich (DE)

(73) Assignee: Salewa Sport AG, Denges (CH)

( * ) Notice: Subject to any disclaimer, the term of this patent is extended or adjusted under 35 U.S.C. 154(b) by 0 days.

(21) Appl. No.: 17/571,876

(22) Filed: Jan. 10, 2022

(65) Prior Publication Data

US 2022/0219069 A1 Jul. 14, 2022

(30) Foreign Application Priority Data

Jan. 11, 2021 (DE) ..... 10 2021 100 316.4

(51) Int. Cl.
*A63C 9/08* (2012.01)
*A63C 7/10* (2006.01)
(Continued)

(52) U.S. Cl.
CPC ..... *A63C 9/0807* (2013.01); *A63C 7/1026* (2013.01); *A63C 7/1033* (2013.01);
(Continued)

(58) Field of Classification Search
CPC ... A63C 9/0807; A63C 7/1026; A63C 7/1033; A63C 9/006; A63C 9/0843; A63C 9/0845; A63C 9/086; A63C 7/104; A63C 9/0847
See application file for complete search history.

(56) References Cited

U.S. PATENT DOCUMENTS

2022/0370886 A1* 11/2022 Indulti ..... A63C 7/1026

FOREIGN PATENT DOCUMENTS

DE 102013224571 A1 6/2015
DE 102013224579 A1 * 6/2015 ..... A63C 7/102
(Continued)

OTHER PUBLICATIONS

European Application No. 22150326.1, Extended European Search Report dated Jun. 20, 2022, 8 pages.
(Continued)

*Primary Examiner* — James A Shriver, II
*Assistant Examiner* — Michael T. Walsh
(74) *Attorney, Agent, or Firm* — Kilpatrick Townsend & Stockton LLP

(57) ABSTRACT

A brake arrangement for a touring binding, adjustable between a braking position and a sliding position. The brake arrangement includes a base having a fastening arrangement for fastening to one or more of a ski or the touring binding, a pedal having a step surface for a shoe on a side of the pedal facing away from the ski, at least one brake arm mounted on the base and on the pedal, at least one first resilient element configured to preload the brake arrangement into the braking position, and a locking element that is movable between an engaged position and a disengaged position. The locking element, in the engaged position, is designed to lock the brake arrangement in the sliding position. The locking element may be preloaded into the engaged position. The brake arrangement may include a blocking element that is adjustable between a blocking position and a release position.

13 Claims, 6 Drawing Sheets

Figure 1A:
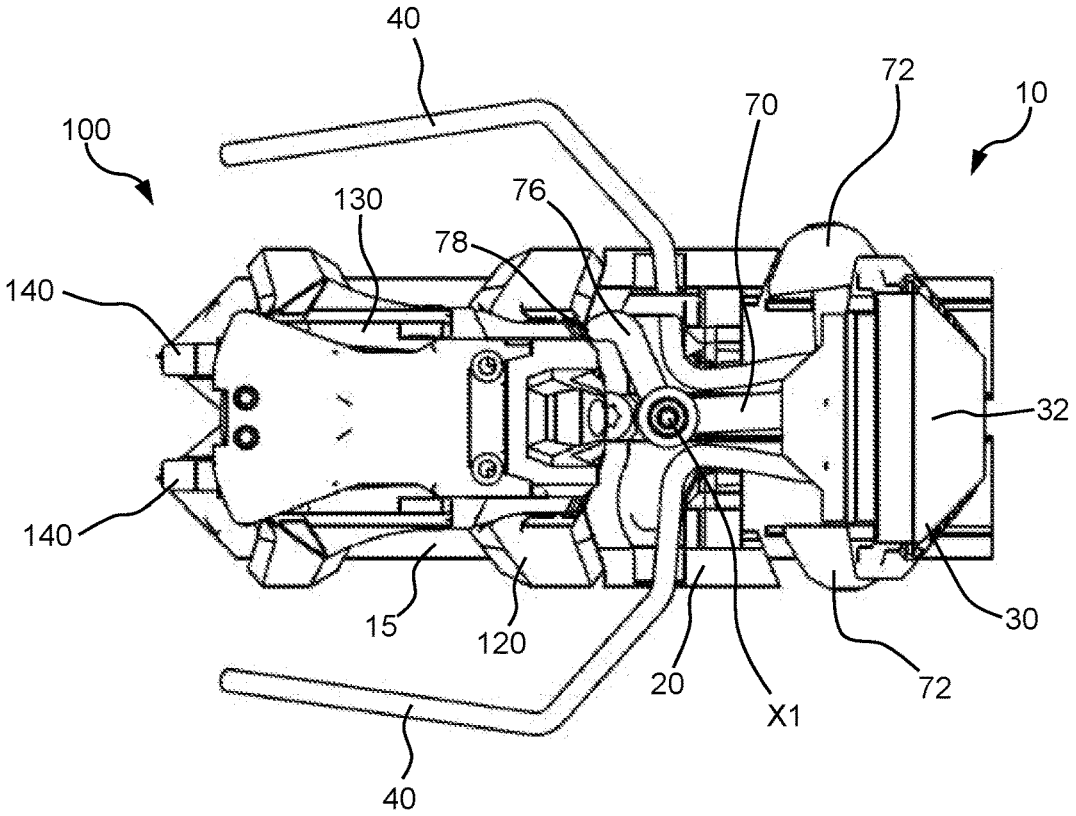

(51) Int. Cl.

| | |
|---|---|
| ***A63C 9/00*** | (2012.01) |
| ***A63C 9/084*** | (2012.01) |
| *A63C 9/086* | (2012.01) |

(52) U.S. Cl.
CPC ..... *A63C 9/006* (2013.01); *A63C 9/0843* (2013.01); *A63C 9/0845* (2013.01); *A63C 9/086* (2013.01)

(56) References Cited

FOREIGN PATENT DOCUMENTS

| | | | | | |
|---|---|---|---|---|---|
| DE | 102013224579 | A1 | | 6/2015 | |
| EP | 2695647 | A1 | * | 2/2014 | ..... A63C 7/102 |
| EP | 3409332 | A1 | | 12/2018 | |
| EP | 3476446 | A1 | | 5/2019 | |
| EP | 3750604 | A1 | * | 12/2020 | ..... A63C 5/02 |
| EP | 3750604 | A1 | | 12/2020 | |
| EP | 3476446 | B1 | * | 4/2021 | ..... A63C 7/1026 |
| FR | 3066700 | A1 | * | 11/2018 | ..... A63C 7/104 |

OTHER PUBLICATIONS

German Application No. DE102021100316.4 , German Search Report dated Sep. 7, 2021, 6 pages.

* cited by examiner

BRAKE ARRANGEMENT FOR A TOURING BINDING

CROSS REFERENCE TO RELATED APPLICATION

This application claims priority to German Patent Application No. 102021100316.4, filed in Germany on Jan. 11, 2021, the entire contents of which are hereby incorporated herein by this reference.

The present invention relates to a brake arrangement for a touring binding, wherein the brake arrangement is adjustable between a braking position and a sliding position, comprising a base having a fastening arrangement for fastening to a ski and/or to the touring binding, a pedal which, on the side thereof facing away from the ski, has a step surface for a shoe, in particular for a heel portion of a ski boot, at least one brake arm which is mounted on the base and on the pedal, at least one first resilient element which is designed to preload the brake arrangement into the braking position, a locking element and a blocking element. The present invention also relates to a heel unit comprising a brake arrangement of this type.

A brake arrangement for touring bindings is intended to brake the ski in the event of a decoupling of a ski boot and a touring binding, for example in the event of a fall of a user, also called triggering, or otherwise loss of a ski on sloping terrain, in order to prevent the complete loss of the ski on the one hand and to prevent danger for other winter sports enthusiasts as a result of the loss of a ski. A brake arrangement for touring bindings therefore represents an important safety feature.

If the binding is coupled to a ski boot, a sole portion of the ski boot conventionally presses a pedal downwards against a force of a resilient element and at least one brake arm connected to the pedal, in particular two brake arms, is/are lifted in a vertical direction with respect to a ski plane to a level above a skiing surface, so that the brake arrangement is in a sliding position and the brake arm(s) for uphill skiing or downhill skiing using the skis can no longer engage with the ground and brake the ski.

In the case of touring bindings, in addition to downhill skiing, uphill skiing is also possible in that so-called climbing skins are fastened to the skiing surface. A touring binding conventionally comprises a heel unit, which can be coupled to a heel portion of a ski boot, and a front unit, which can be coupled to a toe portion of a ski boot. In most cases, both the heel portion is coupled to the heel unit and the toe portion is coupled to the front unit for downhill skiing. In contrast, when uphill skiing, either only the toe portion is pivotably coupled to the front unit so that a ski boot heel can lift off the heel unit, or the heel unit and the front unit are coupled to one another, both remain on the ski boot and comprise a joint on the front unit, which allows lifting of the ski boot from the ski including the heel unit. In the latter case, the arrangement of heel unit and front unit can be locked to the ski for downhill skiing.

Since touring bindings can also be used for uphill skiing, locking or blocking of the brake arrangement in the sliding position is necessary, in which the brake arm(s) are lifted by the ski boot to a level above the skiing surface even without the action of force on the pedal, since, when uphill skiing, a ski boot heel is lifted, and the sole portion of the ski boot no longer presses the pedal down. By locking or blocking the brake arrangement in the sliding position, the ski boot heel can be lifted from the brake arrangement for uphill skiing without the brake arm(s) engaging with the ground and being able to brake the ski.

Systems of this type are known and many different binding models are available on the market which meet the functions and requirements described. However, today's market development is fast-paced and there are some additional requirements placed on brake arrangements for touring bindings.

In touring bindings and brake arrangements for touring bindings, for example, low weight and a less complex structure play an important role. For example, when used in adverse weather conditions and cold temperatures in ice and snow, a simple structure is advantageous, since the binding systems should work absolutely reliably even under the influence of ice and snow. In addition, there is a trend towards comparatively light bindings, which make uphill skiing easier due to their lower weight but also offer sufficient security. As mentioned at the outset, a brake arrangement represents an important safety feature for touring bindings.

In addition, increased user comfort is an extremely relevant requirement for touring bindings and, in particular, also for brake arrangements for touring bindings. For the purpose of a brake lock, the pedal is conventionally pressed down by hand against the force of the resilient element in order to adjust the brake arrangement into the sliding position, and subsequently a blocking element is set from a release position into a blocking position in order to block a movement of the brake arrangement caused by the force of the resilient element directed back into the braking position and thus to lock the brake arrangement in the sliding position. In this case, however, it is desirable to provide a so-called step-in function. This means that the blocking element can first be set into the blocking position without it being necessary to first press the pedal down by hand, and then the brake arrangement can be brought into the sliding position and can be locked there by lowering the ski boot and depressing the pedal using the ski boot.

Another safety feature consists in preventing incorrect operation of the brake arrangement by means of the structure and design of the touring binding and/or the brake arrangement. In this disclosure, the following process is referred to as incorrect operation: It can happen that a user moves the brake arrangement into the sliding position and locks it in the sliding position by means of the blocking element. If he now couples the toe and heel portion of his ski boot to a touring binding for downhill skiing, the touring binding is in a downhill configuration, but the brake arrangement is not in the braking position required for the downhill configuration. The same can happen unintentionally in the case of a step-in process as described above if the user, with the blocking element set in the blocking position, lowers his ski boot in order to couple the ski boot to the touring binding and thereby depresses the pedal and locks the brake arrangement in the sliding position. As a result of the locking of the brake arrangement in the sliding position, in the case of triggering of the binding, the ski decoupled from the ski boot would not be braked by the brake arms and thus possibly be lost, but in particular would represent a considerable danger for other winter sports enthusiasts. It is a requirement of modern touring bindings or brake arrangements for touring bindings to prevent such so-called incorrect operation as much as possible.

Against this background, it is therefore an object of the present invention to provide a brake arrangement or a heel unit which comprises a brake arrangement that is easier to operate, and thus to provide better user comfort, which in particular has an improved brake locking function and/or which provides a function that prevents incorrect operation.

According to a first aspect of the invention, the object of the invention formulated above is achieved by a brake arrangement for a touring binding, wherein the brake arrangement is adjustable between a braking position and a sliding position, comprising a base having a fastening arrangement for fastening to a ski and/or to the touring binding, a pedal which, on the side thereof facing away from the ski, has a step surface for a shoe, in particular for a heel portion of a ski boot, at least one brake arm which is mounted on the base and on the pedal, at least one first resilient element which is designed to preload the brake arrangement into the braking position, a locking element which is movable between an engaged position and a disengaged position and, in the engaged position, is designed to lock the brake arrangement in the sliding position, wherein the locking element is preloaded into the engaged position, and a blocking element which is adjustable between a blocking position, in which the blocking element engages with the locking element in the sliding position of the brake arrangement when the locking element is in the engaged position, and a release position, in which the blocking element does not engage with the locking element.

Important features of the invention are thus the adjustability of the blocking element between the blocking position and the release position and, in particular, the preloading of the locking element into the engaged position. This preload makes it possible that, when the blocking element is set into the blocking position, the locking element remains securely in the engaged position and the brake arrangement is reliably locked in the sliding position and, moreover, automatically returns to the engaged position after an adjustment. This arrangement advantageously allows a step-in function. If the blocking element is set into the release position, however, the locking element does not engage with the blocking element at all, and the brake arrangement remains unlocked and preloaded in the braking position so that it can safely brake the ski in the event of a fall or the like.

At this point, it should be noted that, within the context of this disclosure, in order to simplify visualisation, terms such as "top", "bottom", "front", "rear", "lateral", "vertical", "horizontal", "vertical direction", "transverse direction", "width direction", "longitudinal direction" and the like relate to the point of view of a skier who has stepped into the front unit of a ski binding, in particular touring binding, mounted on a ski using a ski boot, the ski being arranged in a horizontal plane. Furthermore, it should also be noted that the term "ski" as well as the terms containing this term, such as "ski boot", "ski binding", "touring ski binding", "ski plane", "skiing surface", "ski surface", "longitudinal axis of the ski", "central axis of the ski", "transverse direction of the ski", "width direction of the ski", "longitudinal direction of the ski" and the like, are not only to refer to skis in the narrower sense, but also comprise splitboards (snowboards that can be divided lengthways into at least two parts, the individual parts of which can be used in the manner of normal skis), snowshoes or similar boards for walking or sliding on snow and ice. All of these objects or parts thereof are regarded as skis or parts of skis for the purposes of this invention.

In a preferred embodiment, the blocking element in the blocking position thereof can be designed to block the brake arrangement in the sliding position. This can take place in particular through an interaction of the blocking element in the blocking position and the locking element in the engaged position, whereby a particularly reliable brake lock can be provided in a simple manner.

In particular, the blocking element can be mounted on the brake arrangement, in particular on the base, so as to be rotatable about an axis of rotation that is substantially perpendicular to a ski plane, such that said blocking element moves in a plane that is substantially parallel to a ski plane during an adjustment between the blocking position and the release position. A rotatable mounting of the blocking element has proven to be favourable against the background of a possible icing up of the brake arrangement, since a frozen mechanism can be released more easily by a rotary movement than by a linear movement.

It has been found to be advantageous if the blocking element comprises at least one actuating portion which is designed substantially moves in a transverse direction of the ski during an adjustment of the blocking element between the blocking position and the release position and an associated rotation of the blocking element about the axis of rotation in the plane that is parallel to the ski plane, which transverse direction of the ski is perpendicular to a longitudinal direction of the ski. In particular, the idea is to provide an actuating portion on both sides on the left and right in the width direction of the ski. Such actuating portion(s), which can be pulled or pressed by a user in order to adjust the blocking element, ensure simple operation of the blocking element and thus of the brake arrangement. Due to the rotatable mounting of the blocking element, an actuating portion of this type naturally also moves on a circular path; however, a relatively large radius of this circular path compared to a width of the brake arrangement in the width direction of the ski results in a movement substantially in a transverse direction of the ski, in particular the width direction of the ski. The actuating portion(s) are preferably arranged on the outside in the width direction of the ski with respect to the brake arrangement, as a result of which they can be easily reached and further improve user comfort.

In a further preferred embodiment, the pedal can comprise the locking element and the brake arrangement can be designed such that it is locked in the sliding position by an engagement between the pedal and the blocking element when the blocking element is in the blocking position. In an arrangement of this type, the blocking element, when it is set into the blocking position, blocks the brake arrangement in the sliding position by engaging the pedal on which the first resilient element acts directly or indirectly in order to preload the brake arrangement into the braking position. In this way, a reliable brake lock can be achieved.

In this embodiment, the locking element can preferably be arranged on an underside of the pedal pointing in the direction of a ski surface, in particular protrude downwards from the underside of the pedal, and/or the locking element can be mounted on the pedal so as to be pivotable about an axis. If the locking element is provided on the underside of the pedal, it does not protrude from the brake arrangement. In this way, on the one hand, a compact, space-saving arrangement can be achieved and, on the other hand, the locking element can be prevented from being adjusted or released from the engaged position by external action, which can happen with conventional brake arrangements, for example, if the user's ski boots and thus parts of a left and right touring binding possibly hit one another during uphill skiing due to an improperly executed walking movement.

The locking element can preferably be provided in the form of a hook, wherein the hook is designed to engage with a contour of the blocking element in the engaged position of the locking element when the blocking element is in the blocking position. A hook ensures a direct power transmission through a form-fitting connection and thus offers an extremely reliable locking.

In particular, the locking element can be preloaded into the engaged position by a second resilient element. In this case, the second resilient element can be a leg spring which is coupled to the pedal and the locking element. The locking element, which can in particular be formed as a hook, can initially move in the direction of the disengaged position against the spring force of the second resilient element during an adjustment of the brake arrangement from the braking position into the sliding position by interacting with another component, such as the blocking element, and then snap back into the engaged position by the spring force of the second resilient element in order to lock the brake arrangement in the sliding position. In this way, a step-in function can be provided.

Particularly preferably, the locking element can be arranged on the pedal, and the locking element can be designed to interact with the blocking element when the blocking element is in the blocking position during an adjustment of the brake arrangement from the braking position into the sliding position and during an associated movement of the pedal and the locking element in the direction of a ski surface such that the locking element, in a transition position of the brake arrangement between the braking position and the sliding position, initially moves from the engaged position against the preloading force into the disengaged position and returns into the engaged position upon a further movement of the pedal and the locking element in the direction of the ski surface due to the preload. In this way, in turn, an extremely user-friendly step-in function can be provided.

According to a second aspect of the invention, the object of the invention formulated above is achieved by a heel unit for a touring binding, wherein the heel unit is adjustable between a moving position and a walking position, comprising a binding base having a fastening arrangement for fastening to a ski, a binding body which is mounted on the binding base so as to be rotatable about an axis of rotation that is substantially perpendicular to a ski plane in order to adjust the heel unit between the moving position and the walking position, engagement means which protrude from the binding body in order to engage with a heel portion of a ski boot in the moving position of the heel unit, wherein, in the moving position of the heel unit, the engagement means points forwards in a direction of travel and, in the walking position of the heel unit, points in a direction which is different from the direction of travel, in particular differs by about 180°, and optionally a brake arrangement, in particular according to the first aspect of the invention, comprising a base having a fastening arrangement for fastening to a ski and/or to the touring binding, a pedal which, on the side thereof facing away from the ski, has a step surface for a shoe, in particular for a heel portion of a ski boot, at least one brake arm which is mounted on the base and on the pedal, at least one first resilient element which is designed to preload the brake arrangement into the braking position, a locking element which is designed to lock the brake arrangement in the sliding position, and a blocking element which is adjustable between a blocking position, in which the blocking element engages with the locking element, and a release position, in which the blocking element does not engage with the locking element, wherein the blocking element is designed such that it cannot be brought into the blocking position in the moving position of the heel unit.

If the blocking element cannot be brought into the blocking position in the moving position of the heel unit, incorrect operation is also not possible in which a user could move the brake arrangement into the sliding position and lock it in the sliding position by means of the blocking element. Thus, the configuration according to the second aspect of the present invention prevents an incorrect operation of this type.

The blocking element and the binding body can preferably be designed such that the blocking element cannot be brought into the blocking position in the moving position of the heel unit due to an interaction between the blocking element and the binding body. In particular, this means that the blocking element cannot be adjusted into the blocking position or is even fixed in the release position. In this way, incorrect operation is not possible and can be reliably prevented.

In a preferred embodiment of the present invention, the binding body can have a contact portion and the blocking element can have a contact portion, wherein the contact portion of the blocking element is provided on an extension provided on the blocking element and wherein the contact portions are designed in such a way that they rest against one another in the moving position of the heel unit such that the blocking element is blocked in the release position. Thus, a direct stop can be provided between the blocking element and the binding body, which stop prevents the blocking element from being moved into the blocking position in the moving position of the heel unit and an associated specific position of the binding body, whereby incorrect operation is not possible and can be reliably prevented.

In a further preferred embodiment, the blocking element can be mounted on the brake arrangement, in particular on the base, so as to be rotatable about an axis of rotation that is substantially perpendicular to a ski plane, such that it moves in a plane that is substantially parallel to a ski plane during an adjustment between the blocking position and the release position. In addition to preventing incorrect operation, rotatable mounting of the blocking element has proven to be favourable against the background of a possible icing up of the brake arrangement, since a frozen mechanism can be released more easily by a rotary movement than by a linear movement.

In this case, the blocking element can comprise at least one actuating portion which is designed substantially moves in a transverse direction of the ski during an adjustment of the blocking element between the blocking position and the release position and an associated rotation of the blocking element about the axis of rotation in the plane that is parallel to the ski plane, which transverse direction of the ski is perpendicular to a longitudinal direction of the ski. In particular, the idea is to provide an actuating portion on both sides on the left and right in the width direction of the ski. Such actuating portion(s), which can be pulled or pressed by a user in order to adjust the blocking element, ensure simple operation of the blocking element and thus of the brake arrangement. Due to the rotatable mounting of the blocking element, an actuating portion of this type naturally also moves on a circular path; however, a relatively large radius of this circular path compared to a width of the brake arrangement in the width direction of the ski results in a movement substantially in a transverse direction of the ski, in particular the width direction of the ski. The actuating portion(s) are preferably arranged on the outside in the width direction of the ski with respect to the brake arrangement, as a result of which they can be easily reached. In addition to preventing incorrect operation, user comfort can thus be further improved.

According to a third aspect of the invention, the object of the invention formulated above is achieved by a touring binding, comprising a brake arrangement according to the first aspect of the invention and/or a heel unit according to the second aspect of the invention.

This arrangement combines the advantages of the adjustability of the blocking element between the blocking position and the release position and the prevention of incorrect operation.

Figure 1B:
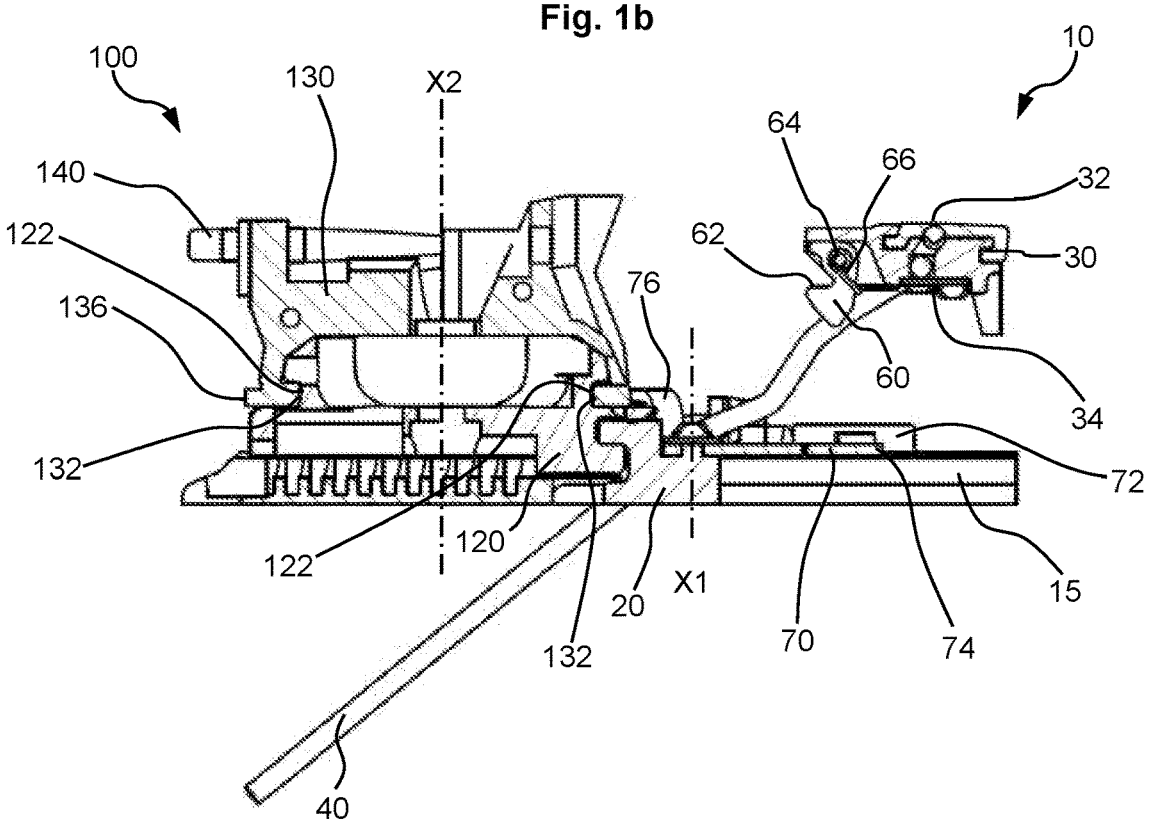

The invention is explained in more detail below on the basis of a preferred embodiment of the present invention with reference to the accompanying drawings. In the drawings:

FIG. 1*a* is a top view of a heel unit according to the embodiment of the present invention in a walking position and of a brake arrangement according to the embodiment of the present invention in a braking position;

FIG. 1*b* is a sectional view of the heel unit and the brake arrangement from FIG. 1*a;*

Figure 2A:
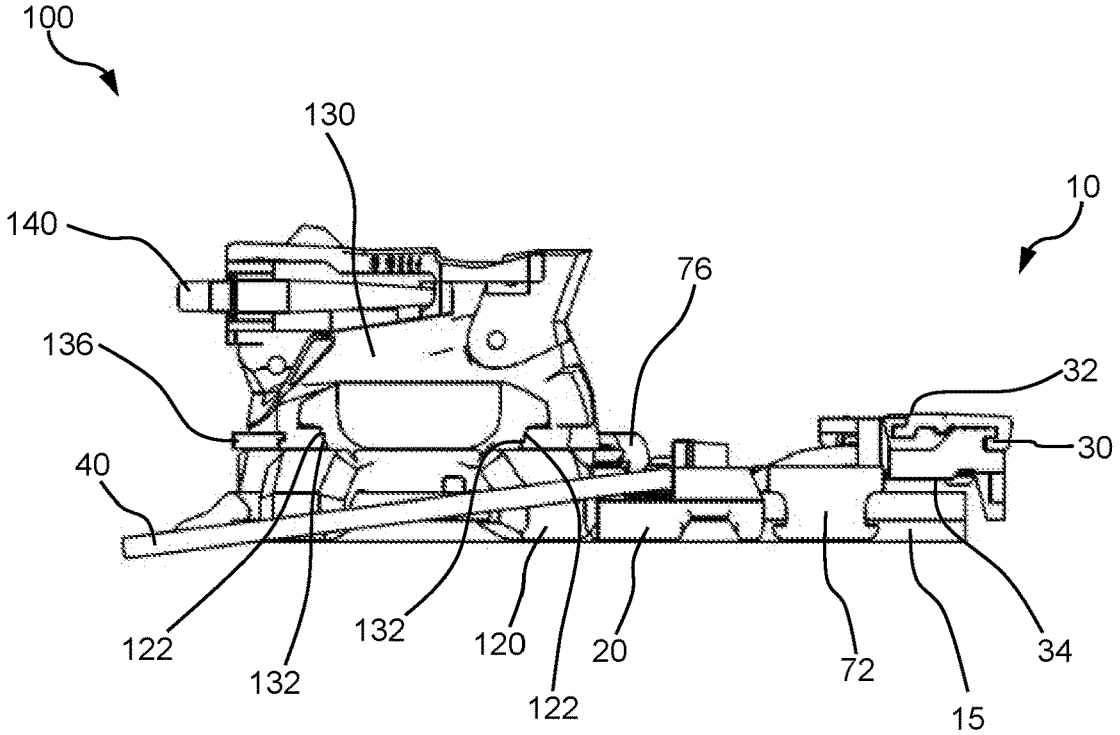
Figure 2B:
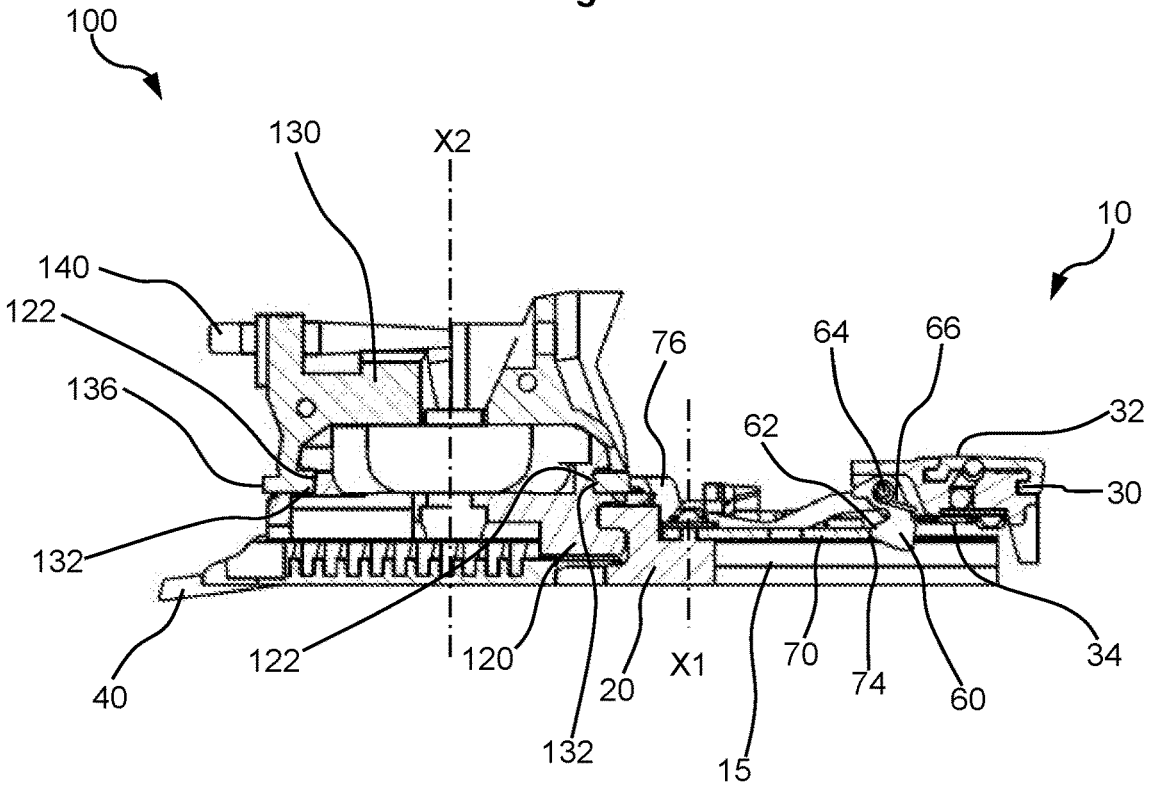

FIG. 2*a* is a side view of the heel unit according to the embodiment of the present invention in the walking position and of the brake arrangement according to the embodiment of the present invention in a transition position between the braking position and a sliding position;

FIG. 2*b* is a sectional view of the heel unit and the brake arrangement from FIG. 2*a;*

Figure 3A:
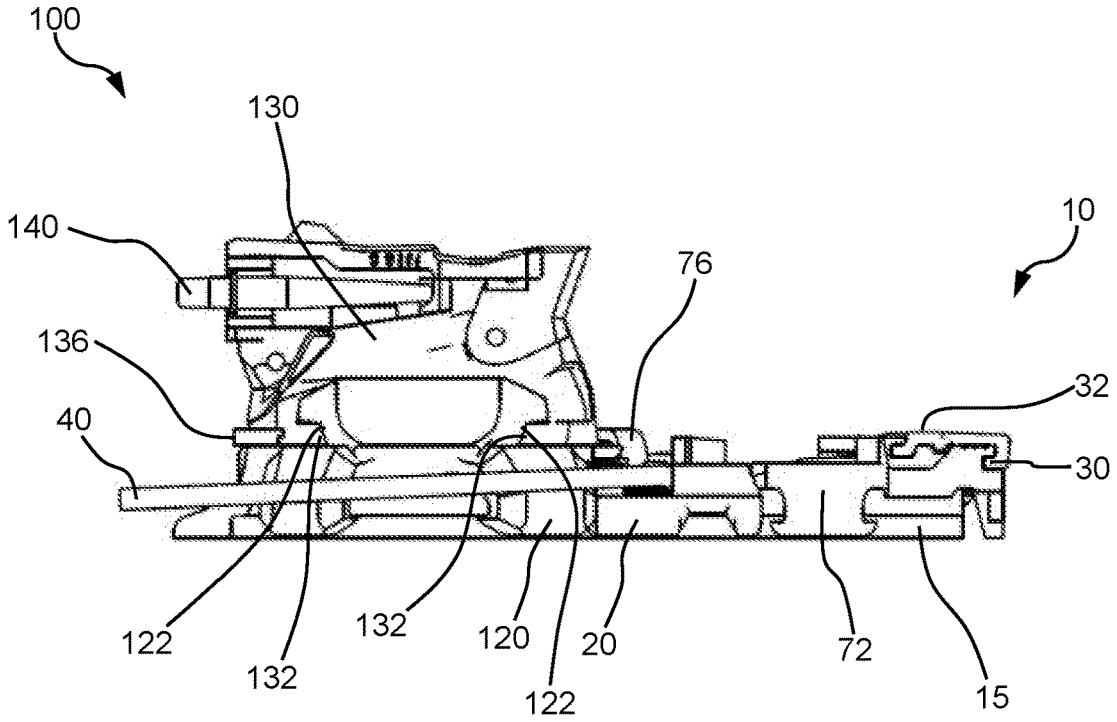
Figure 3B:
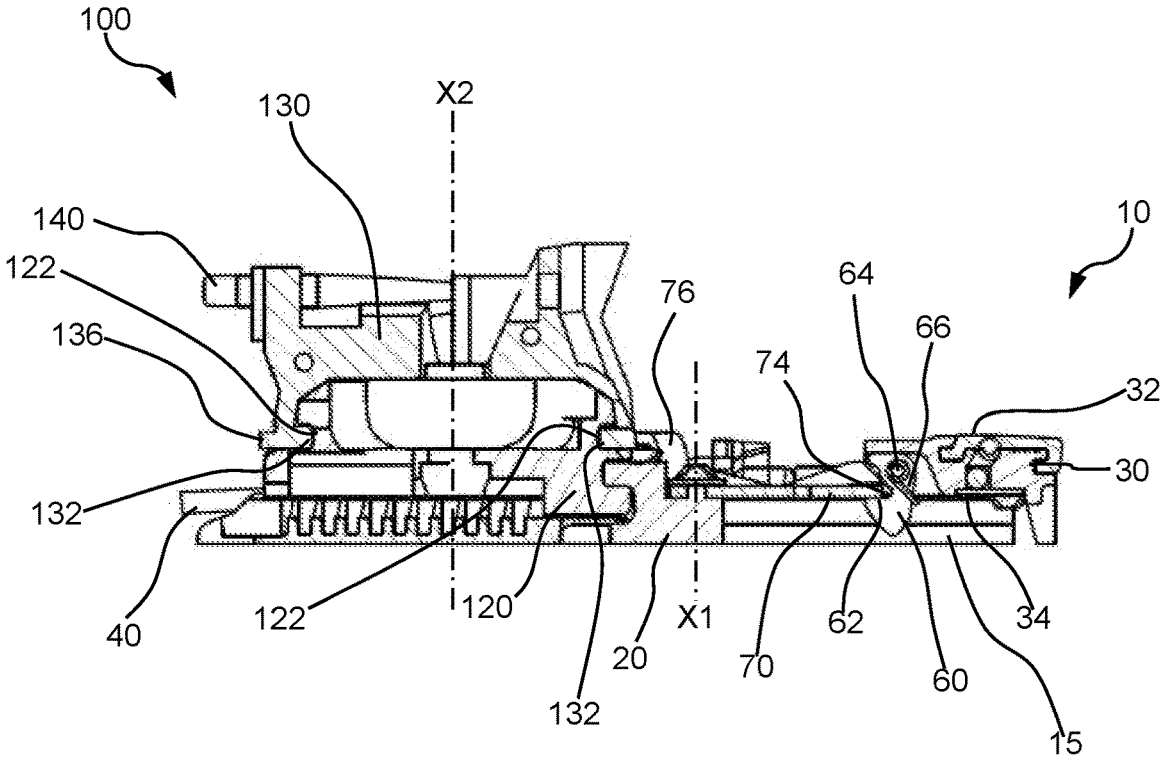

FIG. 3*a* is a side view of the heel unit according to the embodiment of the present invention in the walking position and of the brake arrangement according to the embodiment of the present invention in the sliding position;

FIG. 3*b* is a sectional view of the heel unit and the brake arrangement from FIG. 3*a;*

Figure 4A:
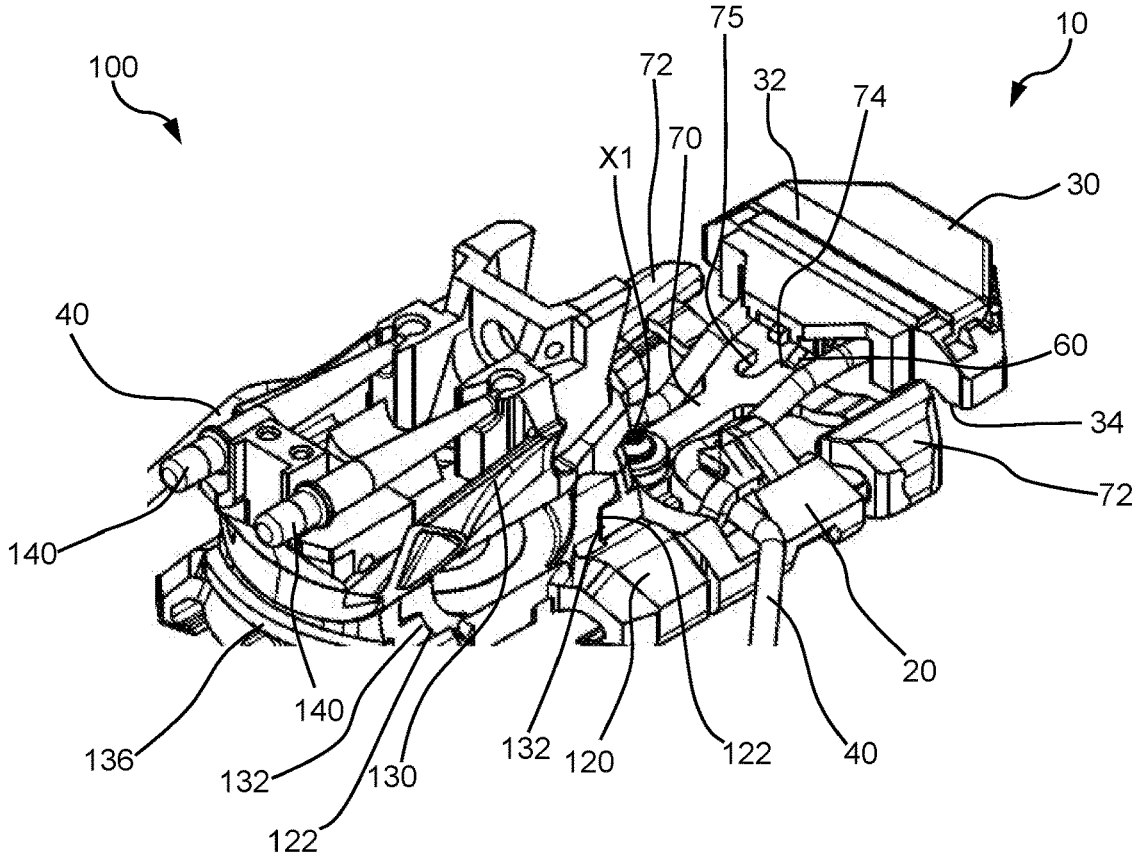

FIG. 4*a* is a detail of a perspective view of the heel unit and the brake arrangement from FIG. 2*a;*

Figure 4B:
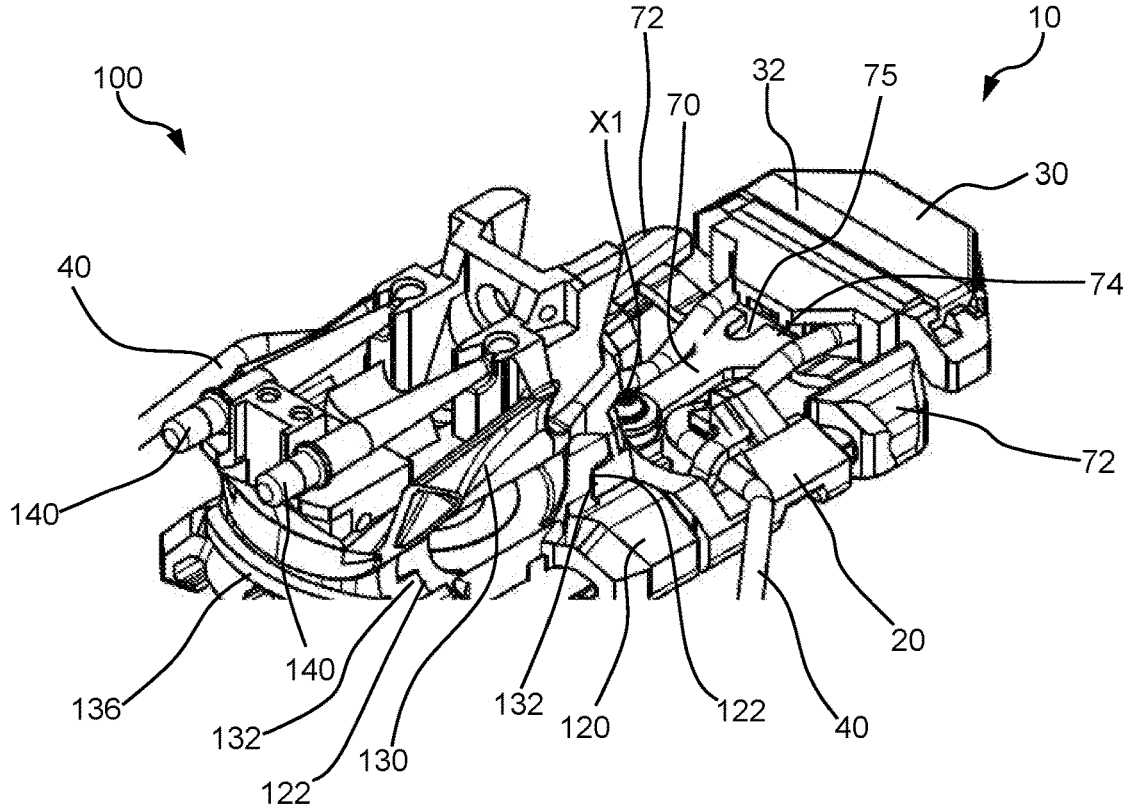

FIG. 4*b* is a detail of a perspective view of the heel unit and the brake arrangement from FIG. 3*a;*

Figure 5A:
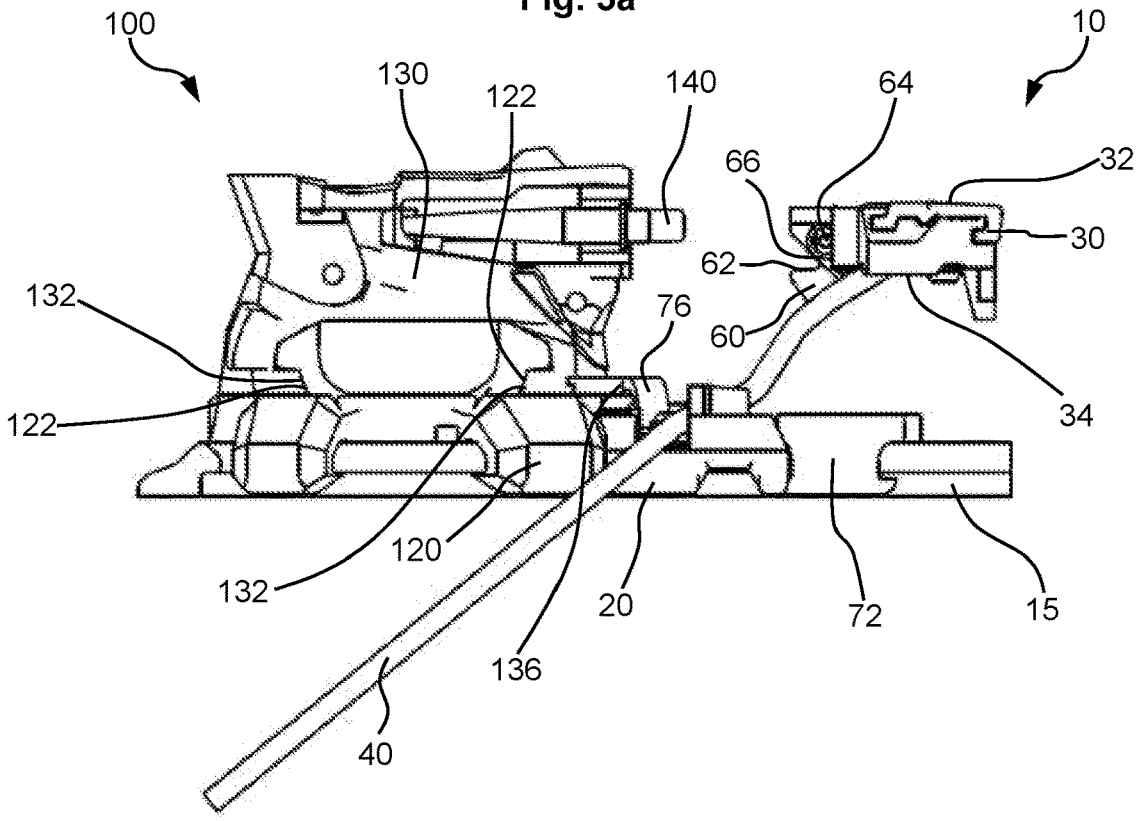
Figure 5B:
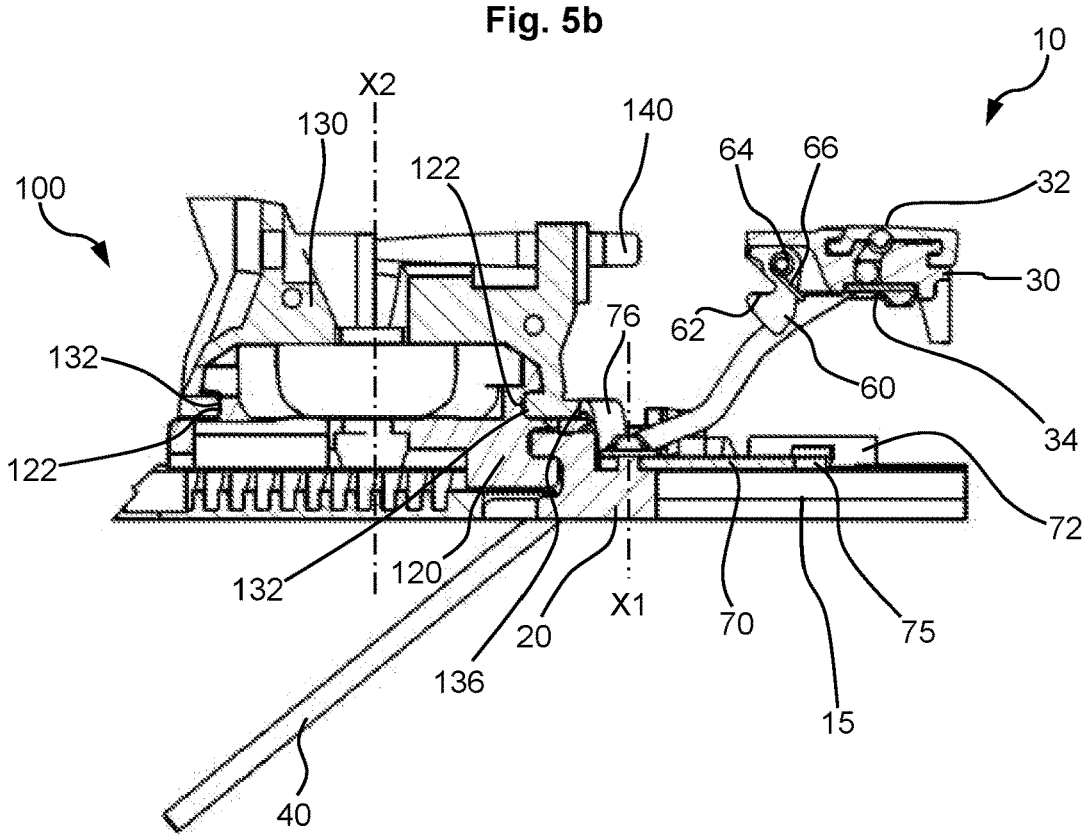

FIG. 5*a* is a side view of the heel unit according to the embodiment of the present invention in a moving position and of the brake arrangement according to the embodiment of the present invention in the braking position;

FIG. 5*b* is a sectional view of the heel unit and the brake arrangement from FIG. 5*a;*

Figure 6A:
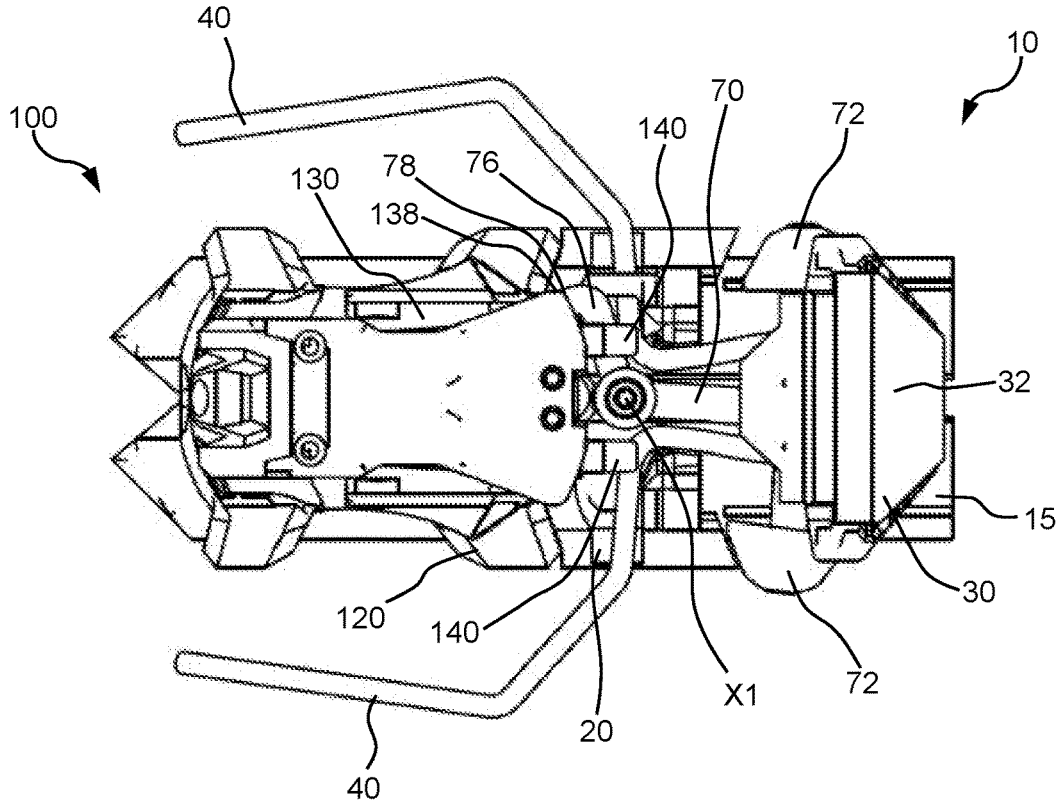
Figure 6B:
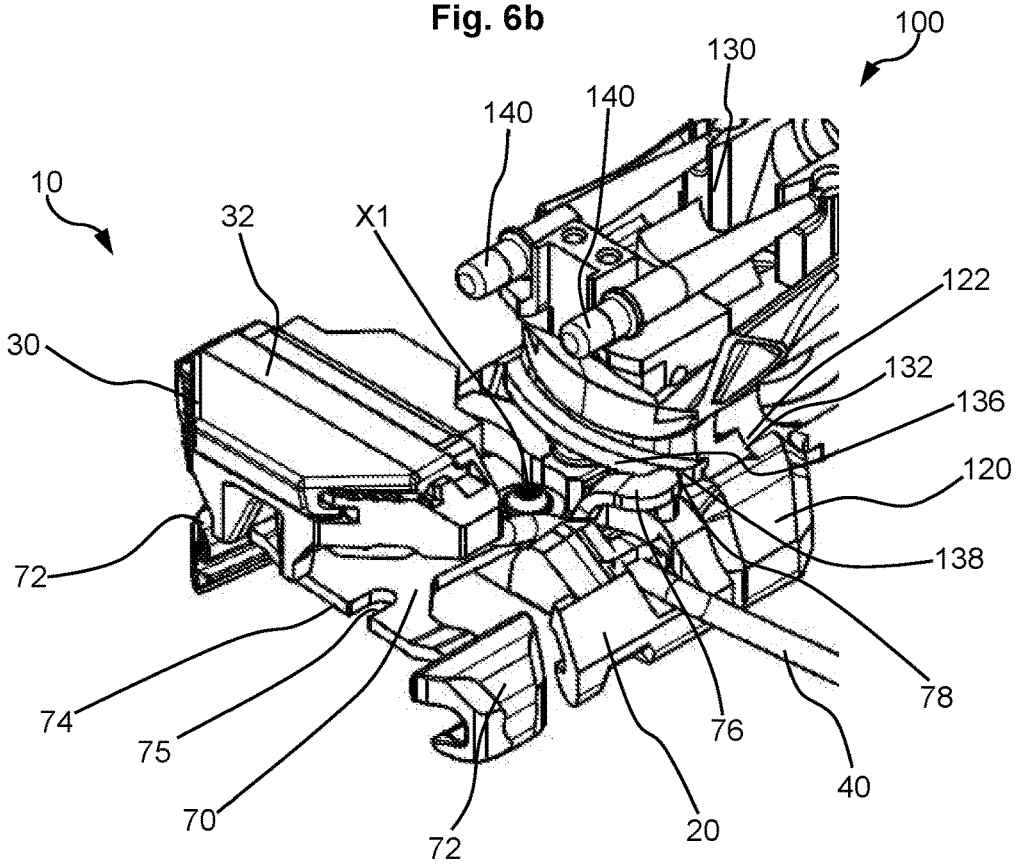

FIG. 6*a* is a plan view of the heel unit and the brake arrangement of FIG. 5*a*; and FIG. 6*b* is a detail of a perspective view of the heel unit and the brake arrangement from FIG. 5*a.*

In FIG. 1*a* to 6*b*, a brake arrangement according to the embodiment of the present invention is generally designated by the reference sign 10, and a heel unit according to the embodiment of the present invention is generally designated by the reference sign 100.

The heel unit 100 is adjustable between a moving position and a walking position. The moving position is shown in FIGS. 5*a*, 5*b*, 6*a* and 6*b*, while the walking position is shown in the remaining FIG. 1*a* to 4*b*. In the moving position, the heel unit 100 is designed to engage a heel portion of a ski boot in order to couple it to the heel unit 100 for downhill skiing, whereas in the moving position the heel unit 100 is designed to release the heel portion so that the heel portion can be lifted from the heel unit 100 for uphill skiing.

The heel unit 100 comprises a binding base 120. In the embodiment according to the invention, the binding base is in the form of a binding slide 120 which is fastened to a binding plate 15 and is displaceable in the longitudinal direction of the ski. The binding plate 15 can in particular be fastened to a ski by means of screws. The heel unit 100 further comprises a binding body 130 which is mounted on the binding base 120 so as to be rotatable about an axis of rotation X2 that is substantially perpendicular to a ski plane in order to adjust the heel unit 100 between the moving position and the walking position. In the preferred embodiment, this mounting consists of a radial bearing 122 formed on the binding base 120 and a complementary radial bearing 132 formed on the binding body 130, which can be designed circumferentially, but in particular only in partial portions such as in a longitudinal direction of the ski at the front and rear.

The heel unit 100 further comprises engagement means 140 protruding from the binding body 130, in particular in the form of protruding pins 140. In the moving position, the engagement means 140 engage with a heel portion of a ski boot and point forwards in a direction of travel. In the walking position, the engagement means 140 point in a direction that differs from the direction of travel. In the preferred embodiment, in the walking position, the engagement means 140 point backwards, counter to the direction of travel, in the longitudinal direction of the ski.

The brake arrangement 10 is adjustable between a braking position and a sliding position. The braking position is shown in FIGS. 1*a*, 1*b*, 5*a*, 5*b*, 6*a* and 6*b* and the sliding position is shown in FIGS. 3*a*, 3*b* and 4*b*. A transition position between the braking position and the sliding position is shown in FIGS. 2*a*, 2*b* and 4*a*. In the braking position, the brake arrangement 10 is designed to brake a ski in the event of a decoupling of the touring binding and ski boot, whereas in the sliding position the brake arrangement 10 is designed not to brake the ski.

The brake arrangement 10 comprises a base 20. In the embodiment according to the invention, the base is provided in the form of a slide 20 which is fastened to the binding plate 15 and is displaceable in the longitudinal direction of the ski. In addition, in the embodiment described, the slide 20 can be coupled to the binding slide 120 in order to connect the brake arrangement 10 and the heel unit 100 to one another.

The brake arrangement 10 further comprises a pedal 30 having a substantially upward-facing step surface 32 for a sole portion of a ski boot. For the purpose of braking the ski, the brake arrangement 10 further comprises at least one brake arm 40; in the preferred embodiment of this invention, two brake arms 40 formed symmetrically with respect to a longitudinal axis of the ski are provided. The brake arms 40 are mounted on the base 20 at central portions thereof and are mounted on the pedal 30 at front portions in the longitudinal direction of the ski. In addition, a resilient element is provided which preloads the brake arrangement 10 into the braking position so that the brake arms 40 can engage with the ground in order to brake the ski. The resilient element can be a spring in the conventional sense but can also be provided as a resiliently flexible bracket or the like. In particular, it can act on the brake arm(s) 40 or on the pedal 30.

The brake arrangement 10 further comprises a locking element 60 which is movable between an engaged position and a disengaged position. The locking element 60 is preloaded into the engaged position and, in the engaged position, locks the brake arrangement 10 in the sliding position. The locking element 60 can preferably be arranged on an underside 34 of the pedal 30 and protrude downwards therefrom. It can be mounted on the pedal 30 so as to be pivotable about an axis 64. The locking element 60 can be preloaded into the engaged position by a second resilient element 66. In the preferred embodiment, the second resilient element 66 can be a leg spring 66 which is coupled to the pedal 30 and to the locking element 60. In particular, the locking element 60 can have a hook shape, as can be seen, for example, in FIG. 1*b*. Such a hook 62 engages with another part of the brake arrangement 10 in the engaged position of the locking element 60 in order to lock the brake arrangement 10 in the sliding position.

The brake arrangement 10 further comprises a blocking element 70 which is adjustable between a blocking position and a release position. In the blocking position, the blocking element 70 engages with the locking element 60 in the sliding position of the brake arrangement 10 when the locking element 60 is in the engaged position. In the release position, the blocking element 70 does not engage with the locking element 60. As a result, the blocking element 70 in the blocking position thereof can block the brake arrangement 10 in the sliding position. This can be done in that the locking element 60, in particular in the form of the hook 62 in the engaged position, engages with a contour 74 of the blocking element 70 when the blocking element 70 is in the blocking position.

The blocking element 70 can be mounted on the brake arrangement 10, in particular on the base 20, so as to be rotatable about an axis of rotation X1 which is substantially perpendicular to a ski plane. As a result, the blocking element 70 can move in a plane that is substantially parallel to a ski plane during an adjustment between the blocking position and the release position. It can also comprise at least one actuating portion 72 and, in the preferred embodiment, comprises an actuating portion 72 on both sides on the left and right in the width direction of the ski, as can be seen, for example, in FIGS. 1*a* and 6*a*. The actuating portions 72 can move substantially in a transverse direction of the ski during an adjustment of the blocking element 70 between the blocking position and the release position and an associated rotation of the blocking element 70 about the axis of rotation X1 in the plane that is parallel to the ski plane, which transverse direction of the ski is perpendicular to a longitudinal direction of the ski. They can be pulled or pressed by a user in order to adjust the blocking element 70. As a result of the rotatable mounting of the blocking element, they move on a circular path, but a relatively large radius of this circular path compared to a width of the brake arrangement 10 in the width direction of the ski results in an almost linear movement in a transverse direction of the ski. The actuating portions 72 may be arranged outside to the left and right with respect to the brake arrangement 10 in the width direction of the ski.

Overall, as can be seen in FIG. 1*a*, among other things, the blocking element 70 can be designed to be substantially T-shaped, wherein the rotatable mounting about the axis of rotation X1 can be provided on a distal end portion of a longitudinal web and the two actuating portions 72 can be provided on both sides on end portions of a transverse web. The contour 74 of the blocking element 70, with which the locking element 60, in particular in the form of the hook 62, can engage, can be arranged on the transverse web between the two actuating portions 72 and can, for example, be a front edge 74 of the transverse web. A recess 75 can also be provided on the transverse web, into which recess the locking element 60 can protrude so as not to engage with the blocking element 70 when the blocking element 70 is in the release position.

An above-described step-in function of the brake arrangement 10 will be explained below with reference to FIGS. 1*b*, 2*b* and 3*b*. In these drawings, the blocking element 70 is shown in the blocking position. During an adjustment of the brake arrangement 10 from the braking position (see FIG. 1*b*) into the sliding position (see FIG. 3*b*), for example when a user steps on the step surface 32 of the pedal 30 with his ski boot, in order moves the pedal 30 and thus the locking element 60 or the hook 62 in the direction of a ski surface, a slope of the hook in the transition position (see FIG. 2*b*) initially strikes the front edge 74 on the transverse web of the blocking element 70. Against the preloading force of the leg spring 66, the hook 62 rotates about the axis of rotation 64 away from the transverse web. In the case of a further movement of the pedal 30 and the locking element 60 in the direction of the ski surface, the hook 62 snaps under the transverse web, returns to the engaged position due to the spring preload and thus locks the brake arrangement in the sliding position (see FIG. 3*b*).

FIG. 4*a* shows what happens when the blocking element 70 is set into the release position. The hook 62 then passes through the recess 75 during the above-described movement of the pedal 30 in the direction of the ski surface and can therefore not engage with the blocking element 70. In FIG. 4*b*, in which the blocking element 70 is shown in the blocking position, it can be seen, however, that the hook 62 is locked under the transverse web 74 and is covered thereby.

An interaction of the heel unit 100 and the brake arrangement 10 is explained below with reference to FIGS. 6*a* and 6*b*.

The blocking element 70 and the binding body 130 are designed such that the blocking element 70 cannot be brought into the blocking position in the moving position of the heel unit 100 due to an interaction between the blocking element 70 and the binding body 130. This can be achieved in that a lip 132 can be provided on the binding body 130 at the front in the direction of travel, which lip has a contact portion 138, and in that an extension 76 can be provided on the blocking element 70, which extension has a contact portion 78, wherein these two contact portions 78, 138 rest against one another in the moving position of the heel unit 100 and form a common stop. This common stop can prevent an adjustment of the blocking element 70 into the blocking position when the heel unit 100 is set into the moving position and the lip 132 and the contact portion 138 of the binding body 130 point forwards in the direction of travel. If, on the other hand, the heel unit 100 is set into the walking position, the contact portion 78 on the extension 76 of the blocking element is spaced apart from the binding body 130, since the portion on which the lip 132 is provided is rotated away, and the blocking element 70 can be moved into the blocking position.

The invention claimed is:

1. A brake arrangement for a touring binding, wherein the brake arrangement is adjustable between a braking position and a sliding position, the brake arrangement comprising:

a base having a fastening arrangement for fastening to one or more of a ski or the touring binding;

a pedal having a step surface for a shoe on a side of the pedal facing away from the ski;

at least one brake arm mounted on the base and on the pedal, wherein the brake arrangement is preloaded into the braking position;

a locking element that is movable between an engaged position and a disengaged position, wherein, in the engaged position, the locking element is configured to lock the brake arrangement in the sliding position, and wherein the locking element is preloaded into the engaged position; and a blocking element that is adjustable between (A) a blocking position, in which the blocking element engages with the locking element in the sliding position of the brake arrangement when the locking element is in the engaged position, and (B) a release position, in which the blocking element does not engage with the locking element, wherein the blocking element is mounted on the brake arrangement, so as to be rotatable about an axis of rotation substantially perpendicular to a ski plane such that the blocking element moves in a plane that is substantially parallel to the ski plane during an adjustment between the blocking position and the release position, wherein the blocking element is rotatable independently of the brake arrangement.

2. The brake arrangement of claim 1, wherein the blocking element in the blocking position thereof is configured to block the brake arrangement in the sliding position.

3. The brake arrangement of claim 1, wherein the blocking element comprises at least one actuating portion configured to move substantially in a transverse direction of the ski during an adjustment of the blocking element between the blocking position and the release position and during an associated rotation of the blocking element about the axis of rotation in the plane that is parallel to the ski plane, wherein the transverse direction of the ski is perpendicular to a longitudinal direction of the ski.

4. The brake arrangement of claim 1, wherein the pedal comprises the locking element, and wherein the brake arrangement is configured to be locked in the sliding position by an engagement between the pedal and the blocking element when the blocking element is in the blocking position.

5. The brake arrangement of claim 1, wherein one or more of (a) the locking element is arranged on an underside of the pedal pointing in a direction of a ski surface, or (b) the locking element is mounted on the pedal so as to be pivotable about an axis.

6. The brake arrangement of claim 5, wherein pointing in the direction of the ski surface comprises protruding downwards from the underside of the pedal.

7. The brake of claim 1, wherein the locking element is provided in a form of a hook and is configured to engage with a contour of the blocking element in the engaged position of the locking element when the blocking element is in the blocking position.

8. The brake arrangement of claim 1, wherein the locking element is preloaded into the engaged position by a resilient element.

9. The brake arrangement of claim 8, wherein the resilient element is a leg spring that is coupled to the pedal and to the locking element.

10. The brake arrangement of claim 1, wherein the locking element is arranged on the pedal, and wherein the locking element is configured to interact with the blocking element when the blocking element is in the blocking position during an adjustment of the brake arrangement from the braking position into the sliding position and during an associated movement of the pedal and the locking element in a direction of a ski surface such that the locking element, in a transition position of the brake arrangement between the braking position and the sliding position, initially moves from the engaged position against the preloading force into the disengaged position, and returns into the engaged position upon a further movement of the pedal and the locking element in the direction of the ski surface due to the preload.

11. The brake arrangement of claim 1, wherein the step surface for the shoe comprises a step surface for a heel portion of the shoe.

12. The brake arrangement of claim 1, wherein the blocking element is mounted on the base.

13. A touring binding, comprising a braking arrangement, adjustable between a braking position and a sliding position, the braking arrangement comprising:

a base having a fastening arrangement for fastening to one or more of a ski or the touring binding;

a pedal having a step for a shoe on a side of the pedal facing away from the ski;

at least one brake arm mounted on the base and on the pedal, wherein the brake arrangement is preloaded into the braking position;

a locking element configured to lock the brake arrangement in the sliding position, wherein the locking element is movable between an engaged position and a disengaged position; and a blocking element adjustable between (A) a blocking position, in which the blocking element engages with the locking element, and (B) a release position, in which the blocking element does not engage with the locking element, wherein the blocking element cannot be brought into the blocking position in the moving position of a heel unit, wherein the blocking element is mounted on the brake arrangement, so as to be rotatable about an axis of rotation substantially perpendicular to a ski plane such that the blocking element moves in a plane that is substantially parallel to the ski plane during an adjustment between the blocking position and the release position, wherein the blocking element is rotatable independently of the brake arrangement.

* * * * *